US007171805B2

(12) United States Patent
Ruehle

(10) Patent No.: US 7,171,805 B2
(45) Date of Patent: Feb. 6, 2007

(54) DEFLECTOR STYLE EXHAUST MANIFOLD

(75) Inventor: Edward A. Ruehle, Plymouth, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 63 days.

(21) Appl. No.: 11/110,521

(22) Filed: Apr. 20, 2005

(65) Prior Publication Data

US 2006/0236687 A1 Oct. 26, 2006

(51) Int. Cl.
*F01N 7/10* (2006.01)

(52) U.S. Cl. ..... 60/323; 60/313; 60/322

(58) Field of Classification Search ..... 60/274, 60/312, 313, 322, 323, 324
See application file for complete search history.

(56) References Cited

U.S. PATENT DOCUMENTS

| | | | | |
|---|---|---|---|---|
| 1,761,960 | A * | 6/1930 | Armitage | 123/545 |
| 2,230,666 | A | 2/1941 | Martin et al. | |
| 4,288,988 | A | 9/1981 | Curtil | |
| 5,829,249 | A * | 11/1998 | VanRens | 60/298 |
| 5,860,278 | A | 1/1999 | Rodenkirch | |
| 6,324,838 | B1 * | 12/2001 | Stempien et al. | 60/323 |
| 6,962,048 | B2 * | 11/2005 | Ashida et al. | 60/302 |

* cited by examiner

*Primary Examiner*—Binh Q. Tran
(74) *Attorney, Agent, or Firm*—Ralph E. Smith

(57) ABSTRACT

An exhaust manifold is provided with deflector members positioned between downstream gas inlets and a main gas passage. The deflector members redirect the flow of exhaust gas from the inlets into the general direction of the gas flowing in the main passage as the exhaust gas enters the main passage.

7 Claims, 2 Drawing Sheets

DEFLECTOR STYLE EXHAUST MANIFOLD

FIELD OF THE INVENTION

The present invention relates to an exhaust manifold for controlling combustion gases and more particularly to arrangements for reducing pneumatic interaction between cylinders and optimizing exhaust flow in an exhaust manifold.

BACKGROUND OF THE INVENTION

Prior to the present invention, various exhaust manifolds and methods of controlling exhaust gases have been disclosed in the prior art. U.S. Pat. No. 2,230,666 which issued on Feb. 4, 1941 and is entitled "Exhaust Gas Collector" discloses a plurality of laterally spaced exhaust pipes fluidly connected to the cylinders of an associated internal combustion engine open to a diverging funnel-like main exhaust tube providing reduced back pressure and thereby increasing the power of the engine. U.S. Pat. No. 4,288,988 which issued on Sep. 15, 1981 and is entitled "Method and Apparatus for Improving the Gas Flow in an Internal Combustion Engine Exhaust Manifold" discloses a method and apparatus for damping pressure oscillations in the exhaust manifold of an associated engine by throttling the exhaust gas near the outlet of the cylinders and then accelerating the gas flow in the manifold by providing a uniform flow section therein which is substantially smaller than the cylinder bore. U.S. Pat. No. 5,860,278 which issued on Jan. 19, 1999 and is entitled "Apparatus and Method for Providing a Compact Low Pressure Drop Exhaust Manifold" discloses a method and apparatus for improving flow through the manifold and decreasing pressure drop to enhance engine performance.

While these and other prior manifold constructions control flow of engine exhaust gas as disclosed, one drawback is that such constructions can result in exhaust interference (i.e. a portion of the engine exhaust gas reflected back up the exhaust tube toward non-firing upstream engine cylinders) and reduced output depending on the exhaust order of the engine cylinders. It is therefore desirable to provide an exhaust manifold that is capable of reducing undesirable pneumatic interaction between cylinders and optimizing exhaust flow.

It is known in the art that one solution for reducing undesirable pneumatic interaction is to provide an exhaust gas intake branch on the manifold adjacent to each cylinder of sufficient length (i.e. greater than eight inches) to permit the engine to fire the upstream cylinders prior to exhaust gas from downstream cylinders reaching the main exhaust tube. In this solution, exhaust gas entering the main exhaust passage of the manifold from upstream cylinders creates a sufficient downstream pressure on the exhaust gas previously emitted from downstream cylinders to prevent undesirable pneumatic interaction. However, the compact size of modern vehicle engine compartments makes such designs difficult due to their bulky configurations. It is therefore desirable to provide an exhaust manifold that requires a minimal amount of space within the engine compartment while reducing undesirable pneumatic interaction between cylinders.

SUMMARY OF THE INVENTION

Accordingly, one aspect of the present invention is to provide an exhaust manifold that is capable of reducing undesirable pneumatic interaction between cylinders and optimizing exhaust flow.

Another aspect of the present invention is to provide an exhaust manifold that requires a minimal amount of space within the engine compartment while reducing undesirable pneumatic interaction between cylinders.

In accordance with the foregoing aspects of the invention, an exhaust manifold is shown comprising a housing with a generally rectangular outer wall and providing a longitudinally extending main exhaust gas passage terminating in an outlet at one end and a plurality of discrete inlet branch passages arranged to provide separate gas passages in fluid communication with an associated exhaust valve of an engine. An initial inlet branch passage and an inner wall of the housing are arranged to provide a ninety degree angular change of flow direction as exhaust gas exits an exhaust valve and enters the main exhaust gas passage. The remaining inlet branch passages are arranged to provide a deflector member between each inlet branch passage and the main exhaust gas passage which provides an angular change of flow direction requiring exhaust gas to enter the main exhaust gas passage in the downstream direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
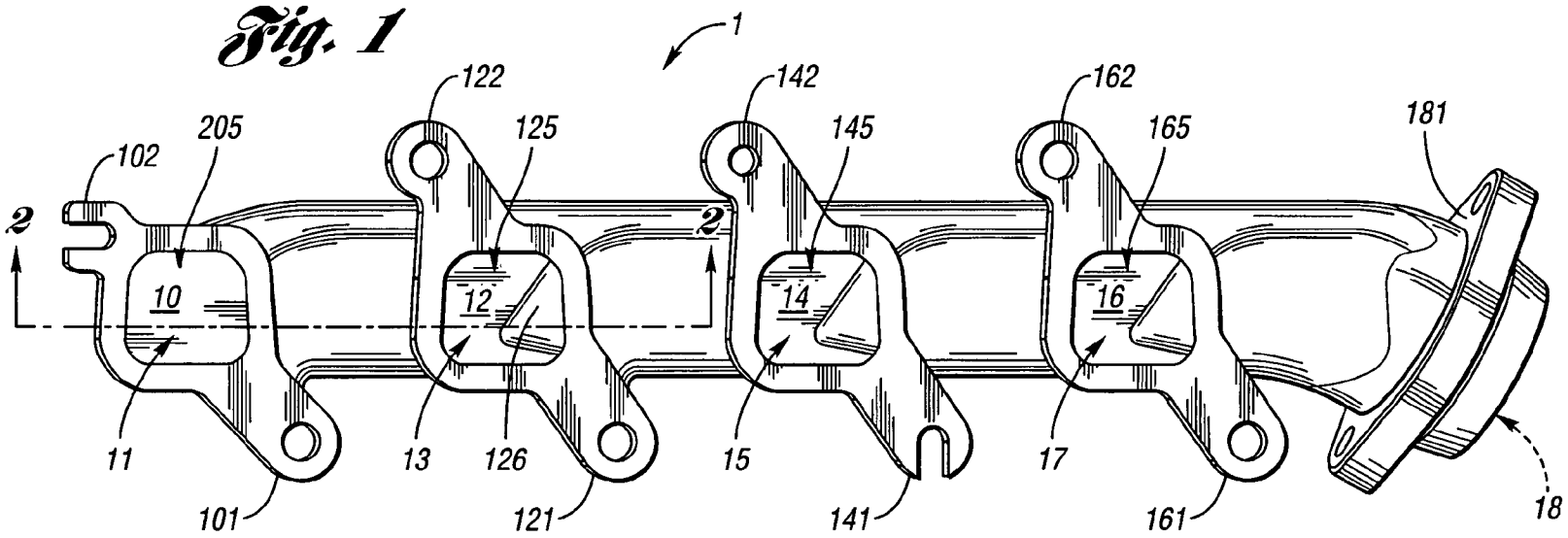
FIG. 1 shows an elevational side view of an exhaust manifold looking toward the engine cylinder head in accordance with the present invention.
Figure 2:
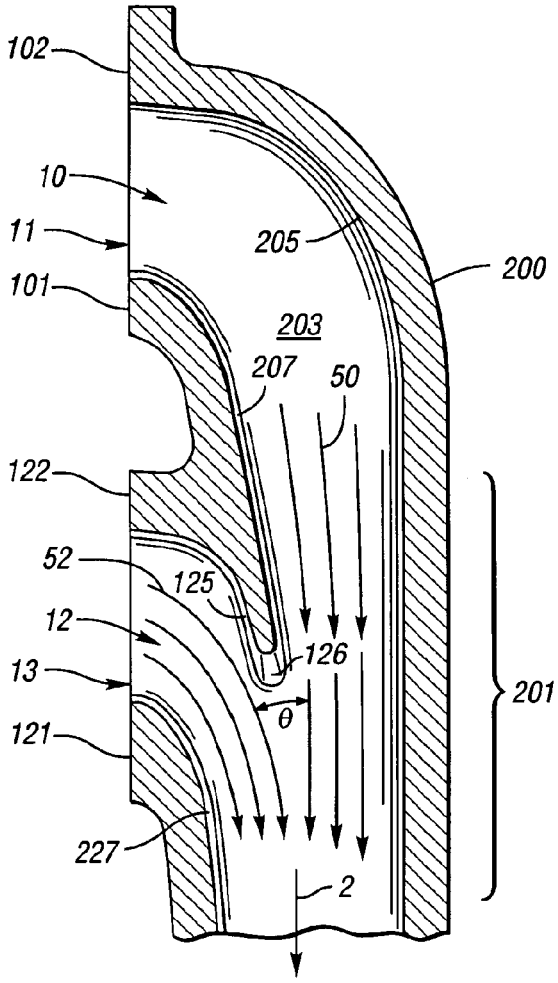
FIG. 2 shows a planer and sectional view of an exhaust manifold looking in the direction 2—2 shown in FIG. 1 in accordance with one embodiment of the present invention.
Figure 4:
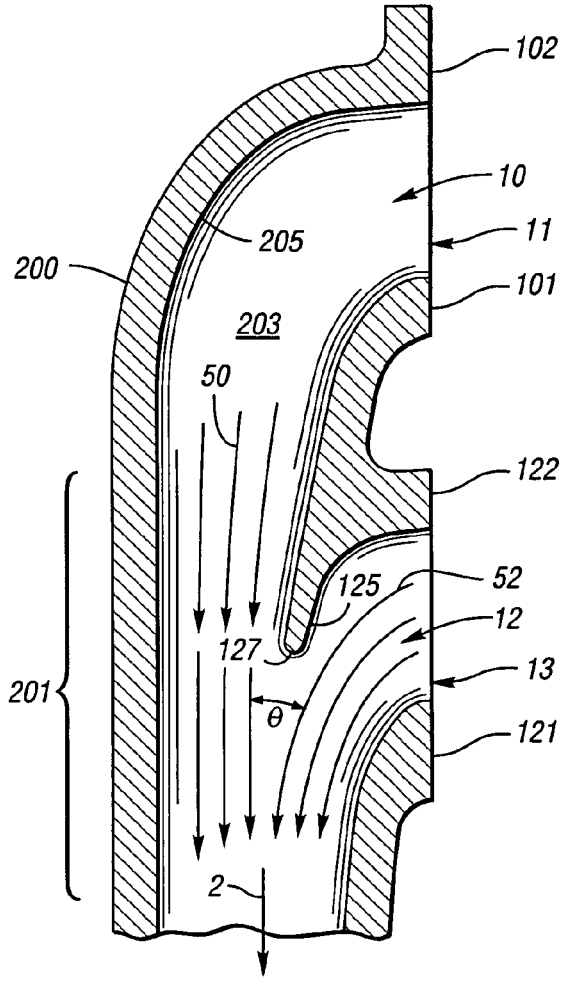
FIG. 4 shows a planer and sectional view of an exhaust manifold looking in the direction 2—2 shown in FIG. 1 in accordance with an alternative embodiment of the present invention.

Turning now in greater detail to the drawings particularly FIG. 1, an exhaust manifold 1 according to an exemplary embodiment of the invention adapted for use with an internal combustion engine is shown. In the illustrated embodiment, an exhaust manifold 1 is adapted to be attached to a right cylinder assembly of a V-8 type internal combustion engine (not shown). The exhaust manifold 1 forms a plurality of exhaust gas inlet branch portions arranged in series. Referring to FIGS. 2 and 4, each exhaust gas inlet branch portion defines an inlet branch passage 10, 12, 14 and 16, respectively, having exhaust gas openings 11, 13, 15 and 17 open to flow of exhaust gas from the passages of the cylinder head as is well known in the art. The inlet branch passages 10, 12, 14 and 16 each receive a discharge of exhaust gas from an associated exhaust opening (not shown) of the engine cylinder head.

Figure 3:
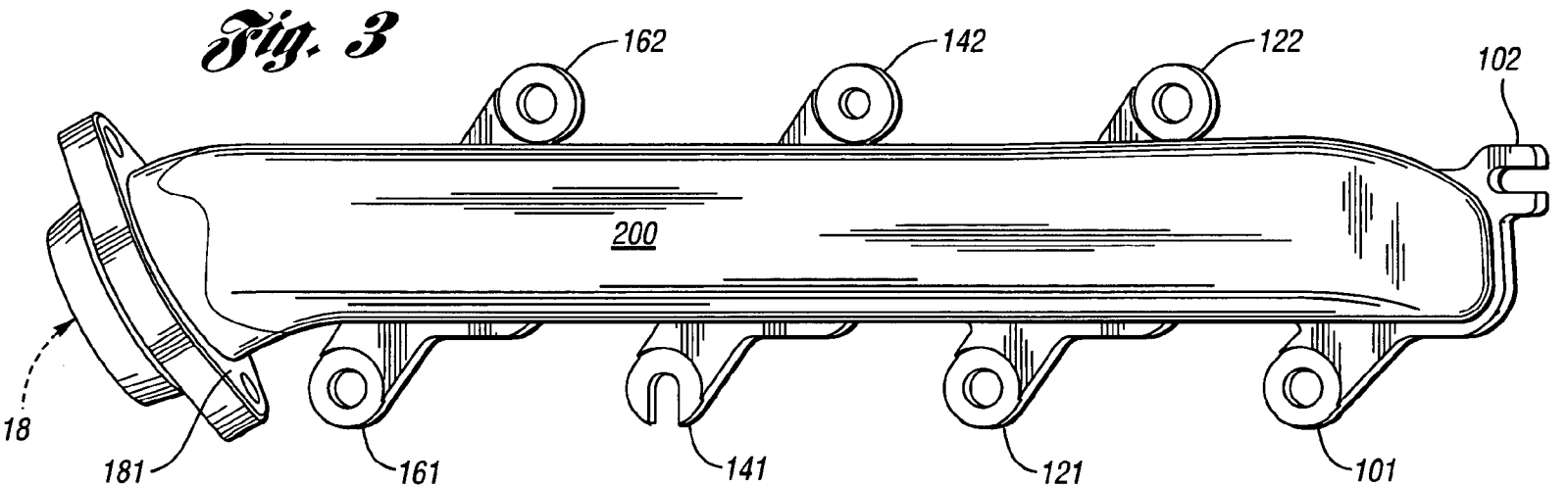
FIG. 3 shows an elevational side view of an exhaust manifold looking away from the engine's cylinder head in accordance with the present invention.

As best seen in FIG. 3, a housing 200 of the manifold 1 generally extends longitudinally with a closed forward end portion and an opened rearward end portion terminating in an outlet 18. When attached to the associated engine cylinder head, the manifold 1 is secured so as to align its inlet branch passages 10, 12, 14 and 16, respectively, with the outlet openings of the engine cylinder head. Specifically, the manifold 1 is attached to the cylinder head (not shown) by fasteners (not shown) extending through brackets 101, 102, 121, 122, 141, 142, 161 and 162. An encircling flange 181 is provided to connect the outlet 18 of the housing 200 to an exhaust pipe (not shown) by means of fasteners (not shown).

As best seen in FIGS. 2 and 4, manifold 1 defines a main exhaust gas passage 203 formed by the internal walls 205, 207, 227 of the housing 200. As each exhaust valve opens for an associated combustion chamber, exhaust gas (such as 50 and 52 shown in FIGS. 2 and 4) flows into the associated inlet branch passages 10, 12, 14 and 16 of the manifold 1.

The flow of exhaust gas through an initial inlet branch passage into the main exhaust gas passage 203 of the manifold 1 occurs in a manner known to those skilled in the art. For example, with respect to inlet branch passage 10, the flow of exhaust gas performs an angular change of direction of approximately ninety degrees after the flow enters into the main exhaust gas passage 203. Each of the internal walls 205, 207 of the housing 200 are formed to gradually turn to provide this angular change of direction as the flow proceeds downstream in the longitudinal direction, as represented by arrows 2, toward the outlet end of the manifold 1.

In accordance with the present invention, a deflector member 125, 145 and 165 is provided to prevent exhaust gases entering the main exhaust passage from downstream inlet branch passages from backing up (i.e. flowing upstream) and pneumatically interacting with exhaust gases attempting to enter the main exhaust passage from upstream inlet branch passages. More specifically, beginning at the side wall of each inlet branch passage 12, 14 and 16 upstream of the outlet end 18 of the manifold 1, a deflector member 125, 145 or 165 is formed as a curved wall within housing 200 extending into main exhaust gas passage 203 from a respective inlet branch passage 12, 14 or 16. The deflector member 125 is as long as the inlet branch passage 12 is wide and the formed section area is no less than that of the inlet branch passage 12. The terminal point of the deflector member 125 is shaped in a manner that exhaust gas flow 50 from the upstream inlet branch passages can not flow past the deflector member 125 at any appreciable angle, and provides at least the same section area as an upstream inlet branch passage. As a result, the exhaust gas flow 50 enters the main exhaust gas passage 203 at an angle θ relative to the main exhaust gas passage 203 that is less than ninety degrees.

In a first exemplary embodiment of this invention as shown in FIG. 4, the deflector member 125 is formed with a substantially plumb end surface 127.

In a secondary exemplary embodiment of this invention as shown in FIG. 2, the deflector member 125 is formed with an inwardly sloping, or ramped, end surface, wherein the top and bottom portions of the wall 126 extend further into the main exhaust passage than the middle section of the wall. Such an arrangement can mitigate the potential formation of cracks in the deflector member 125 due to thermal stress.

Therefore, the present invention advantageously provides a deflector member 125 is that controls any pressure waves from a downstream exhaust gas inlet branch by redirecting the flow from an inlet to be in the general direction of the main exhaust gas flow as it reaches the main exhaust gas passage 203. Thus, exhaust gases can not reach the opening of any non-flowing inlet branch passage, irrespective of its sequential or mechanical position, thus reducing the probability of cylinder to cylinder pneumatic interaction.

Another advantage of this deflector member 125 is the creation of a low-pressure area at the inlet branch passage/main exhaust passage juncture at each of the non-flowing inlet branch passages. As the upstream exhaust gas flow 50 passes by the outside surface of the deflector member 125, a low pressure area is naturally created on the opposite side of the deflector member 125. Since it is directionally correct for the cylinders' exhaust cycle to enter the manifold 1 at the lowest possible conduit pressure, the deflector member 125 assists in the optimization of the exhaust gas flow within the manifold 1.

While only the exhaust manifold 1 associated with the right cylinder head (not shown) has been shown and referred to in FIG. 1 and the text above, a similar left manifold would be provided for the left cylinder head of the V-8 engine. Other engines such as an l-4 (in-line four cylinder), or an l-6 engine would have only one single bank of cylinders and one cylinder head so that only a single exhaust manifold would be required. However, those skilled in the art will recognize that the specific exhaust gas control principles and construction of the exhaust manifold are applicable to other engine configurations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An exhaust manifold for an engine having at least one combustion chamber and at least one exhaust valve for each such combustion chamber, comprising:

a housing formed to provide a longitudinally extending main exhaust gas passage terminating in an outlet at one end thereof;

a plurality of discrete inlet branch passages formed in the housing laterally spaced from one another and arranged to provide separate gas passages operatively connected to an associated exhaust valve of said engine; and a plurality of laterally spaced and radially extending exhaust gas openings in said housing and arranged to pneumatically connect said separate gas passages of the inlet branch passages to said main exhaust gas passage, wherein said exhaust gas openings are disposed in series along the length of one side of said housing, wherein the one of said plurality of inlet branch passages and its associated exhaust gas opening is positioned at an end of said housing opposite said exhaust gas passage outlet, said housing having an inner wall extending from the end inlet branch passage to the main exhaust gas passage so as to redirect the flow of exhaust gas exiting said associated exhaust valve and entering the main exhaust gas passage; and the other inlet branch passages of said plurality of exhaust gas inlet branch passages having an integrally formed deflector member positioned between said exhaust gas opening and said main exhaust gas passage, wherein said deflector member is arranged to provide an angular change of flow direction requiring exhaust gas to enter the main exhaust gas passage in the downstream direction.

2. The exhaust manifold of claim 1 wherein said angular change of flow direction caused by said deflector member causes said exhaust gas to enter the main exhaust gas passage at an angle relative to said main exhaust gas passage that is less than ninety degrees.

3. The exhaust manifold of claim 1 wherein the deflector member comprises a wall within the housing having an end formed as a substantially plumb surface.

4. The exhaust manifold of claim 1 wherein the deflector member comprises a wall with an end formed as a ramped surface.

5. The exhaust manifold of claim 1 wherein the plurality of discrete inlet branch passages is two passages.

6. The exhaust manifold of claim 1 wherein the plurality of discrete inlet branch passages is three passages.

7. The exhaust manifold of claim 1 wherein the plurality of discrete inlet branch passages is four passages.

* * * * *